US006751826B2

(12) United States Patent
Miller

(10) Patent No.: US 6,751,826 B2
(45) Date of Patent: Jun. 22, 2004

(54) TOILET SEAT HINGE

(76) Inventor: Harry R. Miller, P.O. Box 1862, Vernon, B.C. (CA), V1T 8C3

( * ) Notice: Subject to any disclaimer, the term of this patent is extended or adjusted under 35 U.S.C. 154(b) by 0 days.

(21) Appl. No.: 10/184,934

(22) Filed: Jul. 1, 2002

(65) Prior Publication Data

US 2004/0000029 A1 Jan. 1, 2004

(51) Int. Cl.[7] ..... E05D 7/10

(52) U.S. Cl. ..... 16/262; 16/266; 16/386; 16/380

(58) Field of Search ..... 4/236, 234, 240, 4/237, 242.1; 16/262, 263, 264, 266, 270, 271, 272, 382, 386, 342, 380, 381

(56) References Cited

U.S. PATENT DOCUMENTS

| | | | |
|---|---|---|---|
| 531,826 | A | 1/1895 | Bailey |
| 3,471,874 | A | 10/1969 | Dixon |
| 3,653,076 | A | 4/1972 | Warnberg |
| 4,087,884 | A | 5/1978 | Seiderman |
| 4,133,061 | A | 1/1979 | Hurd |
| 4,148,104 | A | 4/1979 | Ginsburg |
| 4,159,548 | A | 7/1979 | Hewson |
| 4,367,567 | A | 1/1983 | Sendoykas |
| 5,448,781 | A | 9/1995 | Miller |
| D377,306 | S | 1/1997 | Decker |

*Primary Examiner*—Chuck Y. Mah
(74) *Attorney, Agent, or Firm*—Oyen Wiggs Green & Mutala

(57) ABSTRACT

There is provided a toilet seat hinge which allows different seats to be quickly replaced or substituted and which will adapt to different manufacturers' bowls. This is accomplished by providing removable hinge pins to secure the seat to the hinge, and adjustable connections from the hinge base to the toilet bowl. The base of the hinge may also be integral with the toilet bowl.

8 Claims, 9 Drawing Sheets

TOILET SEAT HINGE

TECHNICAL FIELD

The invention relates to the field of toilet seats, and more particularly to a hinge for securing the toilet seat and cover which is adaptable to different seats and different toilets.

BACKGROUND

Currently toilet seats and seat covers are connected to two hinges which are each secured to the toilet bowl by a threaded bolt which extends through a hole provided in the bowl and is secured by a nut. The bolts may either be integral with the seat hinge or may be separate and extend through holes in the seat hinge. It is therefore difficult to replace or substitute a seat or cover with a different seat or cover since the entire hinge assembly must generally be replaced. Further, different manufacturers may use different spacing for the hinges and bolt holes, so seats are not interchangeable among manufacturers. A specialized toilet seat, such as the Combination Toilet Seat disclosed in the present inventor's U.S. Pat. No. 5,448,781 may be suitable for one manufacturer's toilet bowl but may not fit another's. There is therefore a need for a toilet seat hinge which allows different seats to be quickly replaced or substituted and which will adapt to different manufacturers' bowls.

SUMMARY OF INVENTION

The present invention provides a toilet seat hinge which allows different seats to be quickly replaced or substituted and which will adapt to different manufacturers' bowls. This is accomplished by providing removable hinge pins to secure the seat to the hinge, and adjustable connections from the hinge base to the toilet bowl. The base of the hinge may also be integral with the toilet bowl.

BRIEF DESCRIPTION OF DRAWINGS

In drawings which illustrate preferred embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
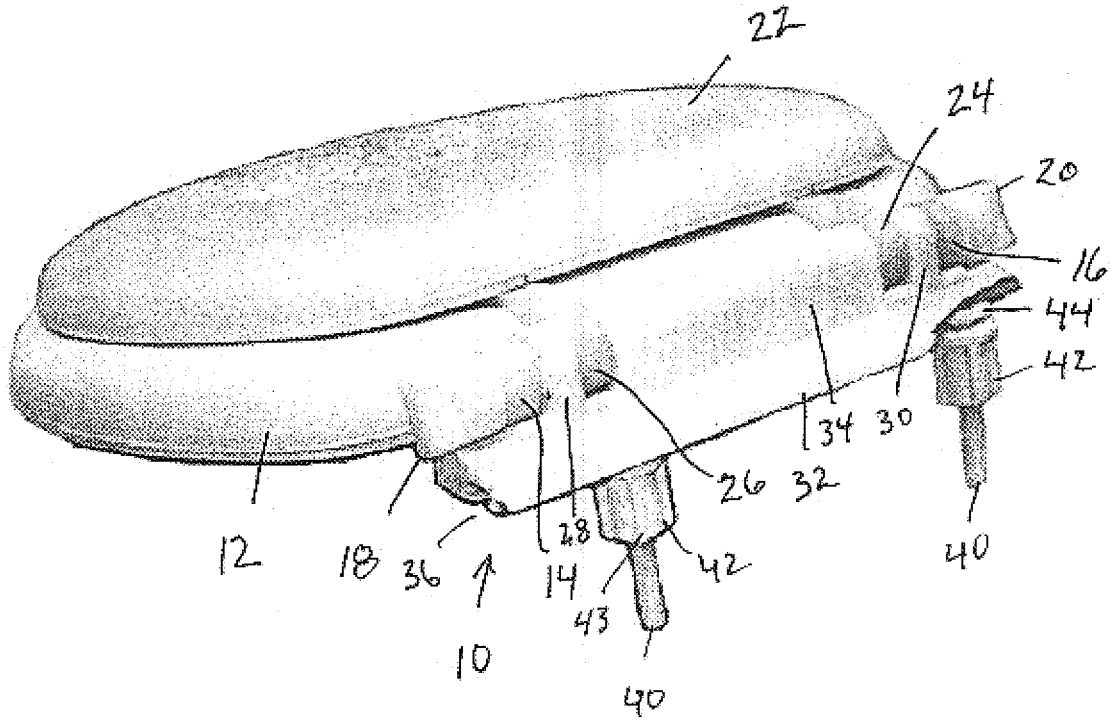
FIG. 1 is a perspective view of the invention attached to a toilet seat and cover, with the hinge partially cut-away to illustrate the bolt attachment.

With reference to FIG. 1, the hinge of the invention is generally designated as 10. A toilet seat 12 is hingedly connected to hinge 10 by hinge lugs 14, 16 which are secured to the toilet seat 12 by screws or the like and which have cylindrical bores for receiving hinge pins 18, 20. Toilet seat cover 22 is hingedly connected to hinge 10 by hinge lugs 24, 26 which are secured to the toilet seat cover 22 by screws or the like and which have cylindrical bores for receiving hinge pins 18, 20. Hinge 10 has flanges 28, 30 which have cylindrical bores for receiving hinge pins 18, 20. Hinge 10 has a base portion 32 having tracks 36 adjacent either end, as described in further detail below, and a central cylindrical block or body portion 34. Attachment bolts 40 have nuts 42 and heads 44 which slide in tracks 36.

Figure 2:
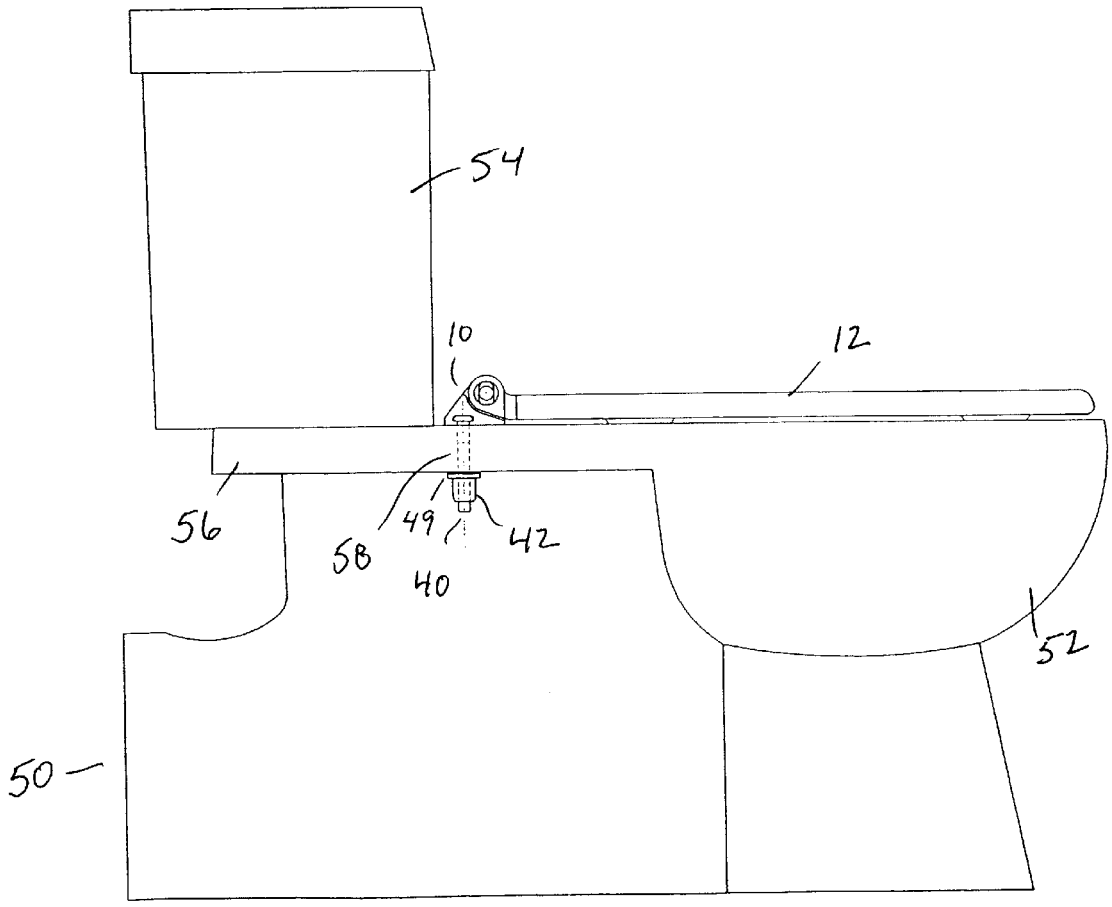
FIG. 2 is a side elevation view of the invention mounted on a toilet with an attached toilet seat.
Figure 3:
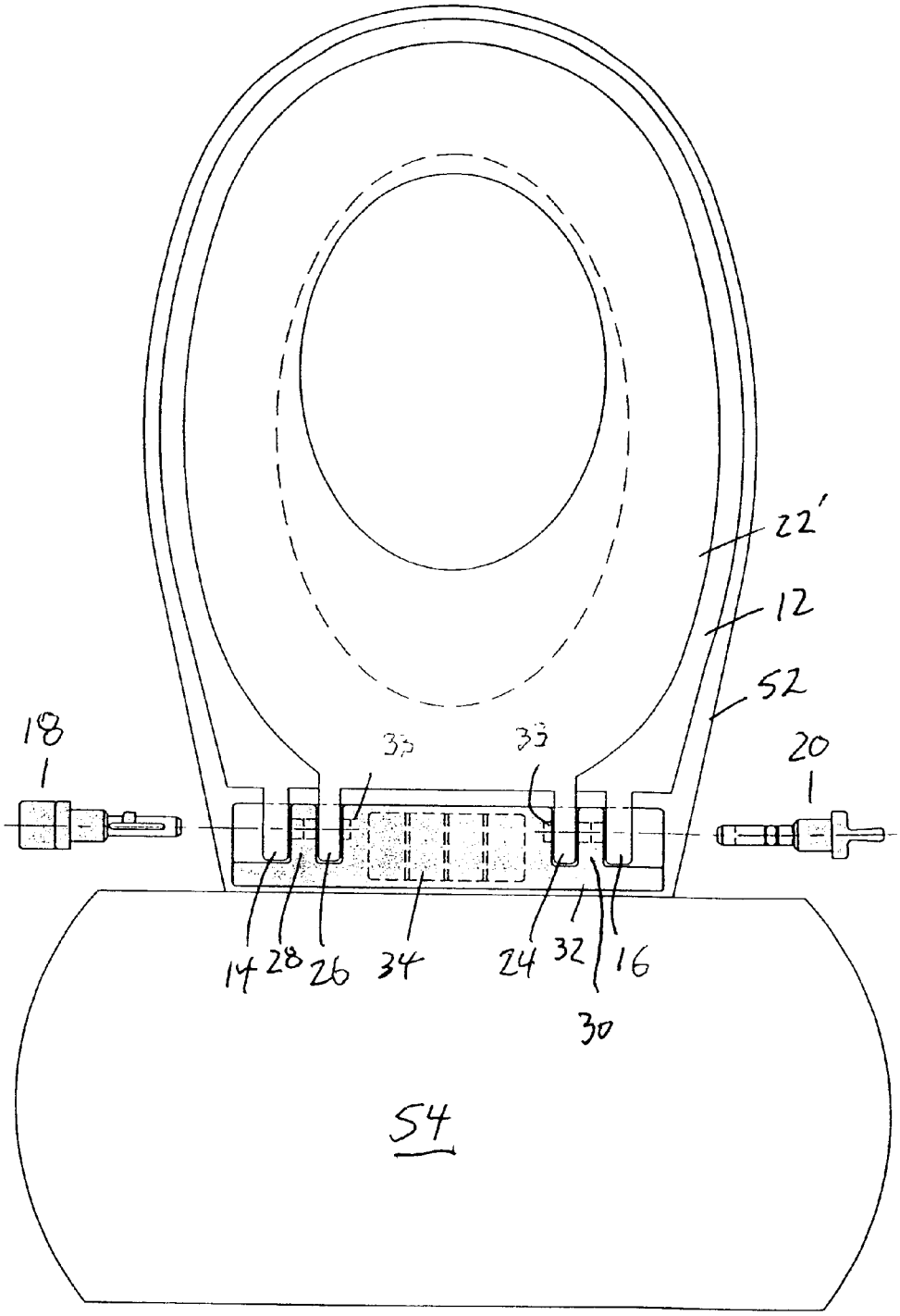
FIG. 3 is a top view of the invention mounted on a toilet with an attached toilet seat, with hinge pins removed for illustration.

FIG. 2 illustrates hinge 10 attached to toilet 50 having toilet bowl 52, tank 54 and bowl flange 56. Hinge 10 is secured through holes 58, shown in dotted outline, through bowl flange 56. In FIG. 3 a second child's seat 22' is shown substituted for the seat cover 22 although a three-part Combination Toilet Seat having two nested seats and a cover, as disclosed in the present inventor's U.S. Pat. No. 5,448,781, may also be used. Hinge pins 18, 20 extend through cylindrical passages in connectors 14, 26, 16, 24, cylindrical passages in flanges 28, 30 and into holes 33 in body 34.

Figure 4:
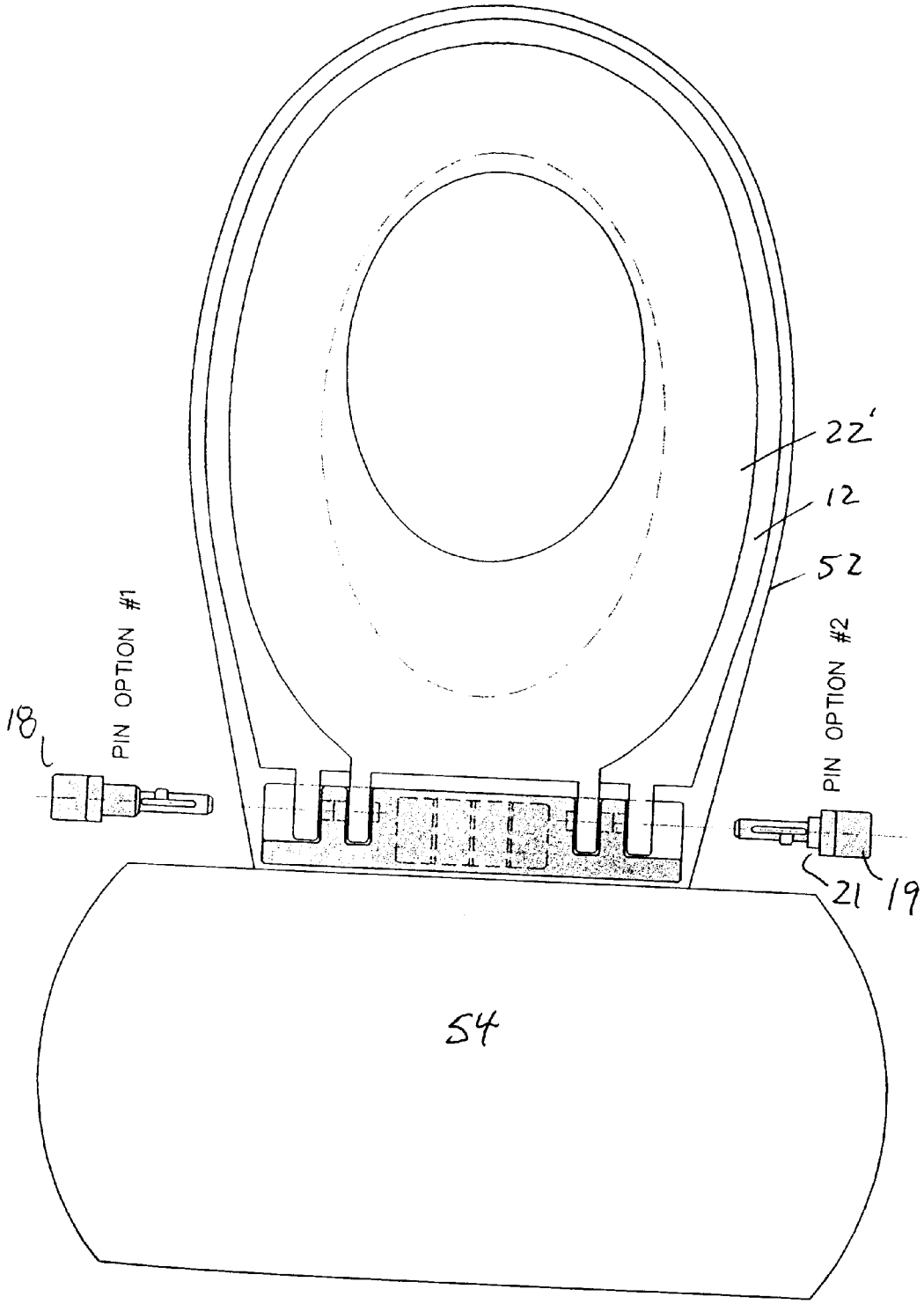
FIG. 4 is a top view of the invention mounted on a toilet with an attached toilet seat, with hinge pins removed for illustration in which a second embodiment of the hinge pin is illustrated.
Figure 8:
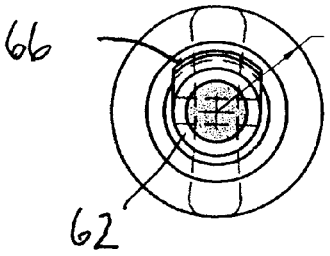
FIG. 8 is a right end view of the hinge pin used with the invention.
Figure 6:
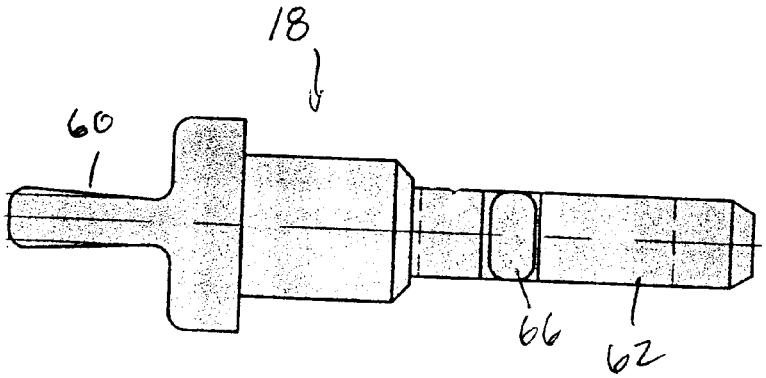
FIG. 6 is a top view of the hinge pin used with the invention.
Figure 7:
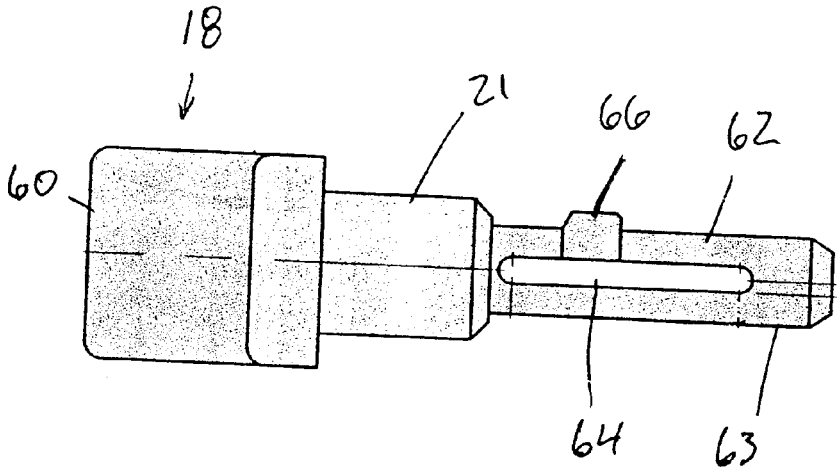
FIG. 7 is a top view of the hinge pin used with the invention.
Figure 9:
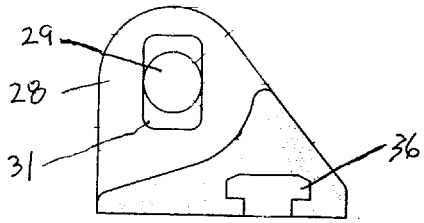
FIG. 9 is a side elevation view of the hinge.
Figure 10:
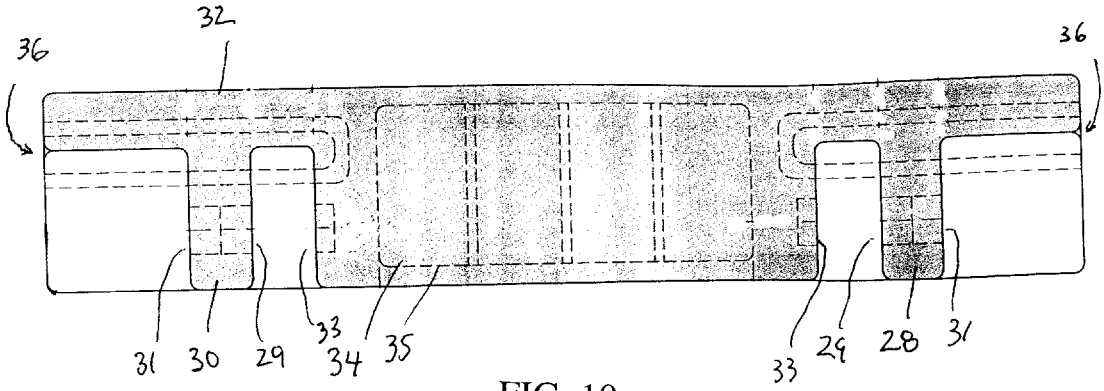
FIG. 10 is a top view of the hinge.
Figure 11:
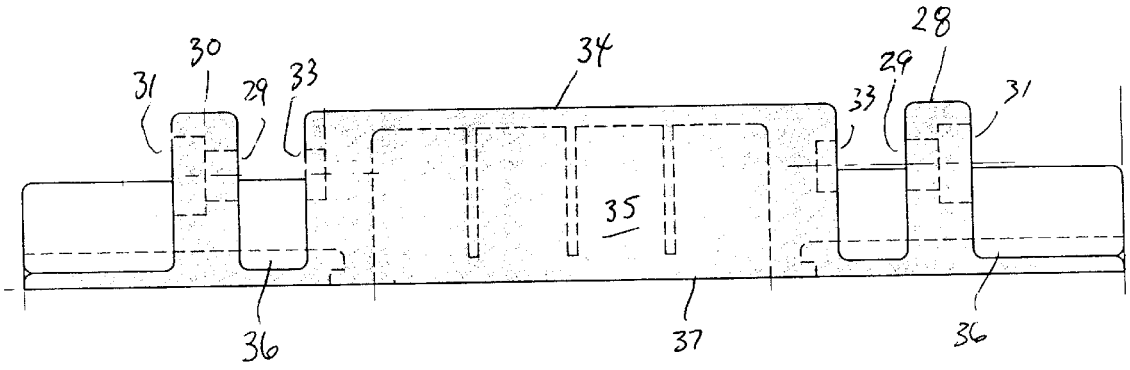
FIG. 11 is a front view of the hinge.
Figure 12:
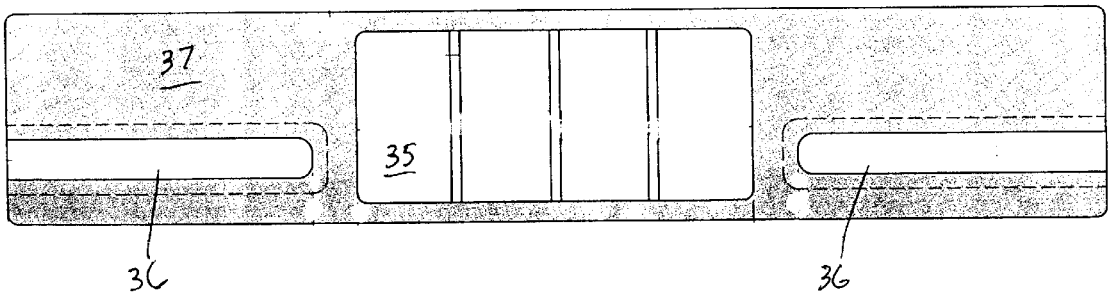
FIG. 12 is a bottom view of the hinge.

FIG. 4 shows a variant of the hinge pin 19 in which the length of the pin is reduced by reducing the length of the cylindrical portion 21. The second variant 19 is useful where a two-part seat is used. Where a three-part seat such as the Combination Toilet Seat disclosed in the present inventor's U.S. Pat. No. 5,448,781 is used the longer cylindrical portion 21 as in hinge pin 18 is required since the pin extends through an extra pair of lugs. The hinge pin 18, shown in more detail in FIGS. 6, 7 and 8, is also described in the present inventor's U.S. Pat. No. 5,448,781 which is incorporated herein by reference. It is formed of a hard but resilient material such as plastic and has cylindrical body 21 having a grasping flange 60 extending from one end and elongated pin 62 extending from the other end. Pin 62 has a central slot 64 cut out along the central axis of pin 62 which causes pin 62 to have some diametric resiliency in a direction perpendicular to the length of the pin and the direction of the slot. A rounded camming protrusion 66 is provided on pin 62 to hold the pins in place in the manner described below.

FIGS. 9 through 12 illustrate in further detail the hinge base 32. It has a lower surface 37 which bears against the upper surface of toilet bowl 52 and may have a cut-out 35 to reduce the amount of material required for manufacture. Flanges 28 and 30 have an outer rectangular aperture 31 and an inner cylindrical aperture 29. Body 34 also has two cylindrical apertures 33. Apertures 29 and 33 have a diameter slightly greater than the diameter of pin 62 so they can receive the end 63 of hinge pin 18. Apertures 29 and 33 have a diameter slightly less than the diameter of protrusion 66 so that protrusion 66 is prevented from extending beyond aperture 31. The height of aperture 31 is slightly greater than the diameter of protrusion 66 but the width is slightly less. This permits the portion of hinge pin 18 with protrusion 66 to enter aperture 31 freely when the protrusion 66 is aligned with the longer dimension of the aperture 31, but when rotated 90 degrees, the protrusion 66 is cammed against the vertical sides of aperture 31 which compresses pin 62 due to the presence of slot 64, causing protrusion 66 to bear against the vertical sides of aperture 31 with a friction fit. The apertures in hinge lugs 14, 16 are preferably oblong in shape, with a longer dimension slightly greater than the diameter of protrusion 66 and a width greater than pin 62 but less than the width of aperture 31, so that when the toilet seat 12 is in the position shown in FIG. 1, binge pin 18 can be inserted through connectors 14 and 16 and when rotated, protrusion 66 is cammed against the sides of aperture 31 and prevented from being withdrawn through the apertures in connectors 14 and 16. The apertures in connectors 24 and 26 be cylindrical and have a diameter slightly greater than that of pin 62.

Figure 13:
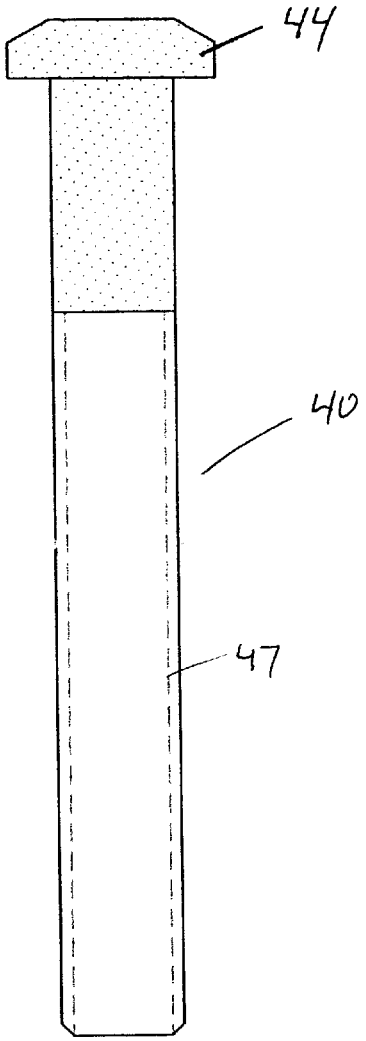
FIG. 13 is a side elevation view of the preferred bolt used with the hinge.
Figure 14:
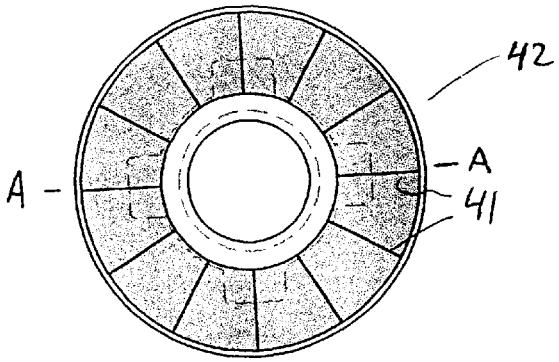
FIG. 14 is a top view of the nut used with the invention.
Figure 15:
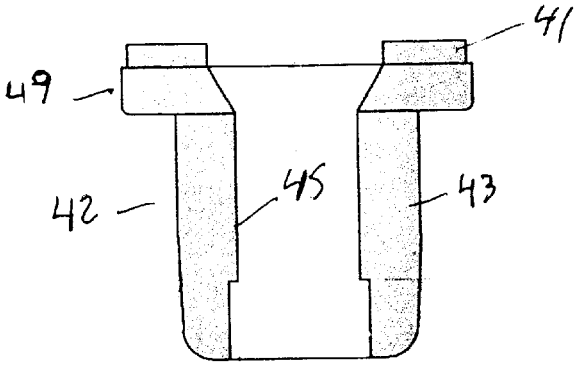
FIG. 15 is a cross-section of the nut taken along lines A—A of FIG. 14.

As shown in FIGS. 13–15, nut 42 has a central threaded passage 45 which threadedly engages threads 47 on bolt 40. Nut 42 has a head 49 with angled teeth 41 to securely engage the underside of flange 56.

In operation, heads 44 of bolts 40 are slid along tracks until the spacing appropriate to the spacing of holes 58 in bowl flanges 56 is determined. Bolts 40 are then extended through the holes 58 and secured in place with nuts 42. The toilet seat 12 and toilet seat cover 22 are then installed on the hinge 10 as described above.

Figure 5:
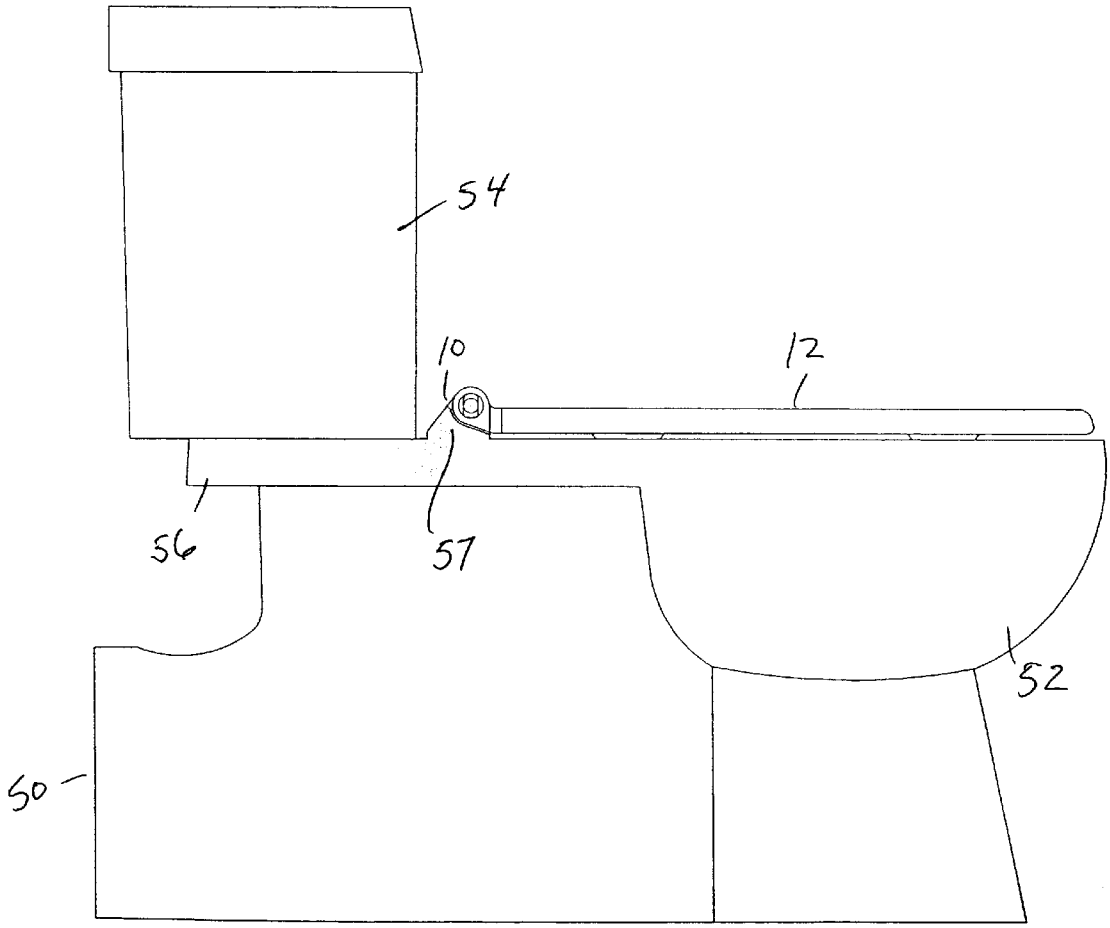
FIG. 5 is a side elevation view of a further embodiment of the invention, with the hinge integral with the toilet bowl.

According to a further embodiment of the invention as shown in FIG. 5, the toilet bowl 52 is provided with flanges 28, 30 and body 34 on a hinge base 57 integral with the toilet bowl 52. Preferably the base 57 and flanges 28, 30 and body 34 are built into the bowl itself by molding or casting. This removes the need for securing by bolts 40 and nuts 42 and similarly no tracks 36, cut-out 35 or holes 58 are present. The structure of flanges 28, 30, body 34, with apertures 29, 31, 33 and hinge pins 18, 20 are otherwise the same as described above.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A toilet seat hinge assembly for connecting a toilet seat to a toilet bowl wherein said toilet bowl is provided with at least two seat-mounting apertures for releasably securing said hinge assembly using at least two fasteners, each fastener having a head, said hinge assembly comprising a hinge body having a lower surface for mounting to said toilet bowl and two hinge pins, wherein said lower surface of said hinge body is provided with an elongated channel adapted to slidably receiving a head of a fastener whereby the location of said fastener when securing said hinge assembly to said toilet bowl may be adjusted; said hinge body being adapted to releasably receive said hinge pins, wherein said hinge body is provided with two lobes, one for receiving each said hinge pin, each lobe having a circular aperture and an elongated recess communicating with said circular recess, wherein each said hinge in has a radially deformable cylindrical pin element having a first end sized to be received in said circular aperture and a camming element extending radially from said cylindrical pin at a lengthwise location spaced from the end of said cylindrical pin, said elongated recess having a width greater than the diameter of said circular aperture and less than the diameter of each said cylindrical pin in the location of said camming element, and the height of said elongated recess is greater than the diameter of each said cylindrical pin in the location of said camming element, whereby each said hinge pin may extend into said lobe with each said camming element aligned with the longer dimension of said elongated recess and when rotated, each said camming element bears against the edges of said elongated recess to retain each said hinge pin in each said lobe in a friction fit.

2. The toilet seat hinge assembly of claim 1 wherein said hinge assembly has first and second ends and said channel is open from either said first or second ends to permit entry of said fastener head.

3. The toilet seat hinge assembly of claim 2 further comprising a second elongated channel wherein said two elongated channels are adapted to slidably receive a head of a fastener, each one of said two elongated channels being adjacent either end of said hinge assembly, and said channels are open from either said first or second ends to permit entry of said fastener heads, whereby the location of said fasteners when securing said hinge assembly to said toilet bowl may be adjusted.

4. The toilet seat hinge assembly of claim 1 further comprising third and fourth binge pins, wherein each said third and fourth hinge pin has a radially deformable cylindrical pin element having a first end sized to be received in said circular aperture and a camming element extending radially from said cylindrical pin at a lengthwise location spaced from the end of said cylindrical pin, whereby each said hinge pin may extend into each said lobe with each said camming element aligned with the longer dimension of said elongated recess and when rotated, said camming element bears against the edges of said elongated recess to retain each said hinge pin in each said lobe in a friction fit, said cylindrical pin elements of said first and second binge pins each having a length greater than the length of the cylindrical pin elements of said third and fourth hinge pins whereby said first and second hinge pins axe adapted to connect a toilet seat having two seat elements and a cover to said toilet bowl and said third and fourth binge pins are adapted to connect a toilet seat having only one seat element and a cover to said toilet bowl.

5. A toilet seat hinge assembly for connecting a toilet seat and cover to a toilet bowl wherein said hinge assembly comprises a hinge body for receiving the toilet seat and cover which is integral with said toilet bowl and two hinge pins, said hinge body being adapted to releasably receive said hinge pins, said hinge body is provided with two lobes one for receiving each said hinge pin, each lobe having a circular aperture and an elongated recess communicating with said circular recess, wherein each said hinge pin has a radially deformable cylindrical pin element having a first end sized to be received in said circular aperture and a camming element extending radially from said cylindrical pin at a lengthwise location spaced from the end of said cylindrical pin, said elongated recess having a width greater than the diameter of said circular aperture and less than the diameter of each said cylindrical pin in the location of said camming element, and the height of said elongated recess is greater than the diameter of each said cylindrical pin in the location of said camming element, whereby each said hinge pin may extend into each said lobe with each said camming element aligned with the longer dimension of said elongated recess and when rotated, each said camming element bears against the edges of said elongated recess to retain each said hinge pin in each said lobe in a friction fit.

6. The toilet seat hinge assembly of claim 5 wherein said integral hinge body is formed as an integral casting with said toilet bowl.

7. The toilet seat hinge assembly of claim 5 wherein said integral hinge body is formed as an integral molding with said toilet bowl.

8. The toilet seat hinge assembly of claim 5 further comprising third and fourth hinge pins, wherein each said third and fourth hinge pin has a radially deformable cylindrical pin element having a first end sized to be received in said circular aperture and a camming element extending radially from said cylindrical pin at a lengthwise location spaced from the end of said cylindrical pin, whereby each said hinge pin may extend into each said lobe with each said camming element aligned with the longer dimension of said elongated recess and when rotated, said camming element bears against the edges of said elongated recess to retain each said hinge pin in each said lobe in a friction fit, said cylindrical pin elements of said first and second binge pins each having a length greater than the length of the cylindrical pin elements of said third and fourth hinge pins whereby said first and second hinge pins are adapted to connect a toilet seat having two seat elements and a cover to said toilet bowl and said third and fourth hinge pins are adapted to connect a toilet seat having only one seat element and a cover to said toilet bowl.

* * * * *